US006196103B1

(12) United States Patent
Schneider et al.

(10) Patent No.: US 6,196,103 B1
(45) Date of Patent: Mar. 6, 2001

(54) PUNCH GUIDE ASSEMBLY

(75) Inventors: Joseph Charles Schneider, Ramsey; David A. Berry, Fridley, both of MN (US)

(73) Assignee: Mate Precision Tooling Inc., Anoka, MN (US)

( * ) Notice: Subject to any disclaimer, the term of this patent is extended or adjusted under 35 U.S.C. 154(b) by 0 days.

(21) Appl. No.: 09/135,358

(22) Filed: Aug. 17, 1998

(51) Int. Cl.[7] ..... B26P 5/08
(52) U.S. Cl. ..... 83/635; 83/684; 83/698.91
(58) Field of Search ..... 83/635, 136, 146, 83/140, 138, 142, 143, 698.91, 698.31, 684; 411/516, 817, 518

(56) References Cited

U.S. PATENT DOCUMENTS

| | | | | |
|---|---|---|---|---|
| Re. 29,950 | | 4/1979 | Bartha . | |
| 2,225,342 | * | 12/1940 | Hyatt | 83/136 |
| 2,999,407 | * | 9/1961 | Frangesco | 83/698.31 |
| 3,079,824 | | 3/1963 | Schott . | |
| 3,298,409 | * | 1/1967 | Elson | 411/517 |
| 3,326,580 | * | 6/1967 | Munier et al. | 411/517 |
| 3,391,954 | * | 7/1968 | Callahan | 411/517 |
| 3,566,730 | | 3/1971 | Pancook . | |
| 3,759,130 | | 9/1973 | Patterson . | |
| 3,779,113 | | 12/1973 | Jestin . | |
| 3,871,254 | | 3/1975 | Whistler, Jr. et al. . | |
| 4,104,941 | | 8/1978 | Krueger . | |
| 4,248,111 | | 2/1981 | Wilson et al. . | |
| 4,446,767 | | 5/1984 | Wilson . | |
| 4,836,071 | | 6/1989 | Ersoy . | |
| 4,947,719 | | 8/1990 | Whistler . | |
| 5,131,303 | | 7/1992 | Wilson et al. . | |
| 5,271,303 | * | 12/1993 | Chatham | 83/136 |
| 5,301,580 | * | 4/1994 | Rosene et al. | 83/136 |

* cited by examiner

*Primary Examiner*—M. Rachuba
(74) *Attorney, Agent, or Firm*—Larson & Taylor, PLC

(57) ABSTRACT

A punch guide assembly includes a retaining clip for retaining the stripper plate inside the punch guide or allowing removal thereof without disassembly of any of the remaining components of the punch tool. The retaining clip is easily insertable into the punch guide and removable therefrom through an opening in the sidewall of the punch guide without the use of additional tools.

7 Claims, 4 Drawing Sheets

PUNCH GUIDE ASSEMBLY

FIELD OF THE INVENTION

The present invention relates to a punch guide assembly and, more particularly, a punch guide having an opening therein for insertion of a retaining clip for holding a stripper plate in place in the punch guide, the retaining clip being easily removable from the opening in the punch guide to release the stripper plate and allow removal thereof from the punch guide.

BACKGROUND OF THE INVENTION

A punch unit for use in a punch press generally includes a punch driver connected with a punch. The punch driver includes a punch head at its back end. A preloaded compression means, such as a compression spring, is provided between the punch head and the punch guide. A punch guide receives and guides the punch. A stripper plate is positioned in the bottom of the punch guide. The stripper plate is a hardened plate having an opening with the same shape as that of the punch tip.

During a stroke of the punch, a ram presses down on the punch head forcing the punch tip to enter a workpiece. The preloaded compression means then forces the punch and punch driver out of the workpiece and back to their normal position. As the punch tip exits the workpiece, the stripper plate prevents the edges of the cut hole from following the punch tip.

The punch and stripper plate are often replaced due to wear or because a different shaped punch tip is required. Because the opening in the stripper must closely match the shape of the punch tip, when the punch is changed, it is also typically necessary to change the stripper plate.

Accordingly, the need exists to provide a punch guide assembly, i.e., a combined punch guide and stripper plate, wherein the stripper plate is quickly and easily removed from or inserted into the punch guide without the need for complete disassembly of the punch tool.

SUMMARY OF THE INVENTION

Thus, it is a purpose of the present invention to overcome the drawbacks of the prior art and provide a punch guide assembly which permits a simpler and more rapid installation and removal of the stripper plate.

According to a preferred embodiment of the invention, a punch guide assembly for use in a punch tool includes a punch guide having an open end and at least one opening in a sidewall. A stripper plate is insertable into the open end. A retaining clip is insertable into the opening in the sidewall from the exterior of the punch guide. The retaining clip engages the stripper plate when inserted into the punch guide to retain the stripper plate therein. The retaining clip is readily accessible from the exterior of the punch guide to allow removal of the retaining clip, thereby releasing the stripper plate from the punch guide. In a preferred embodiment, the retaining clip includes two side arms connected at ends thereof by a bar to form a C-shape. These two side arms frictionally engage a groove in opposite sidewalls of the stripper plate when the retaining clip is inserted into the opening in the wall of the punch guide.

The punch guide may include a groove in the interior sidewall which corresponds to the groove in the stripper plate. This groove is engaged by protrusions extending outward from the retaining clip to hold the stripper plate more securely in place in the punch guide.

It is, therefore, an object of the invention to provide a punch guide assembly in which the stripper plate may be removed and replaced without disassembly of the remaining portion of the punch tool.

It is another object of the invention to provide a punch guide assembly in which the stripper plate is easily removed from or inserted into the punch guide without the use of additional tools.

These and other objects of the present invention will become apparent from the detail description to follow.

BRIEF DESCRIPTION OF THE DRAWINGS

There follows a detailed description of the preferred embodiments of the present invention which are to be taken together with the accompanying drawings, wherein.

DETAILED DESCRIPTION OF THE PREFERRED EMBODIMENTS

Referring now to the figures, like elements are represented by like numerals throughout the several views.

Figure 1:
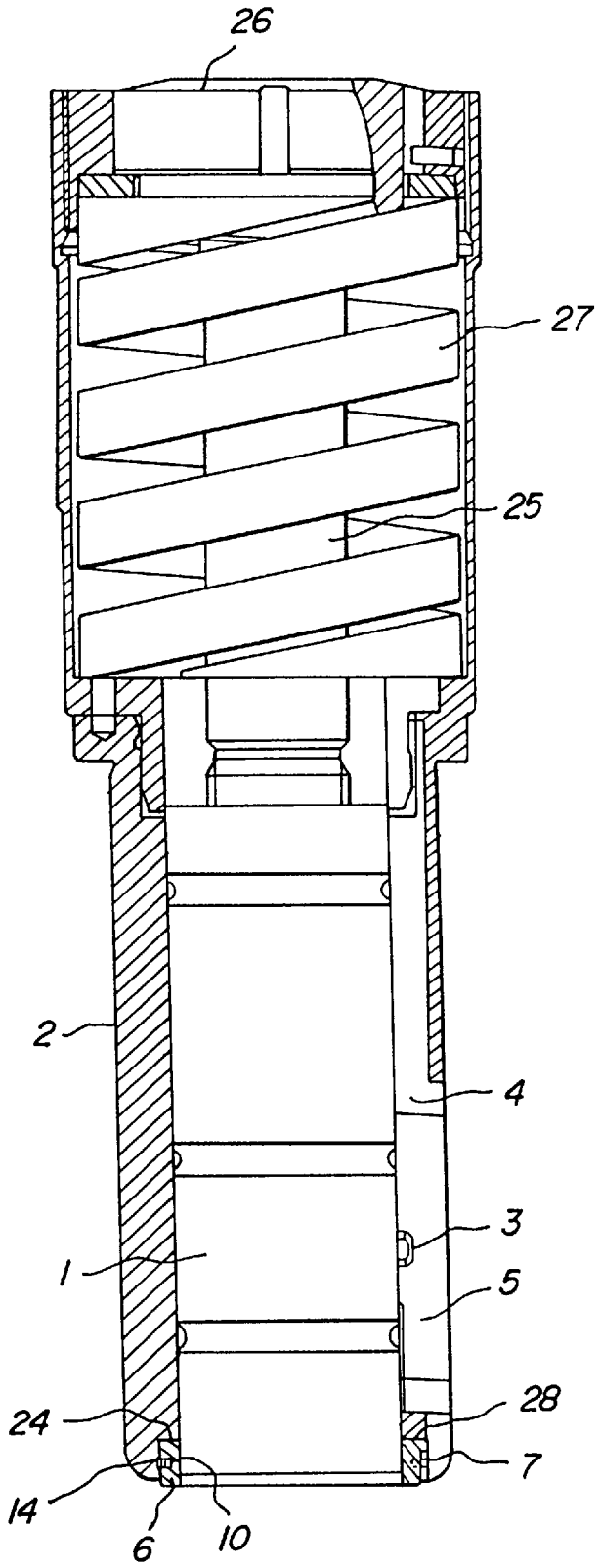
FIG. 1 is a central longitudinal cross-sectional view of a punch unit in the completely assembled state.

FIG. 1 shows a completely assembled punch tool with the stripper plate and retaining clip of the invention shown schematically therein. The punch tool includes a punch 1 which is guided linearly displaceably in a punch guide 2. A punch driver 25 is connected with the punch 1. The punch driver 25 includes a punch head 26 at its back end. A preloaded compression means, such as a compression spring 27, is provided between the punch head 26 and the punch guide 2. Rotation of the punch 1 in relation to the punch guide 2 is prevented by rotation preventing means such as a pin 3 fixed to the punch 1 which engages an interior longitudinal groove 4 in the punch guide 2. An axial groove 5 is opened radially outwardly so that means on the punch press machine, not shown, can engage the groove 5 from the exterior and non-rotatingly maintain it on the punch press machine. A stripper plate 6 is inserted into the lower open end of the punch guide 2 and prevented from further movement into punch guide 2 by shoulder 24 which engages the top end 28 of the stripper plate 6. Stripper plate 6 is then fastened on the lower end of the punch guide 2 by means of a retaining clip 7.

Figure 2:
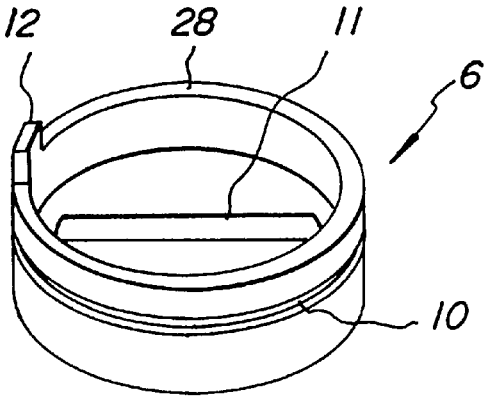
FIG. 2 is a top perspective view of a stripper plate used in the punch guide assembly.
Figure 3:
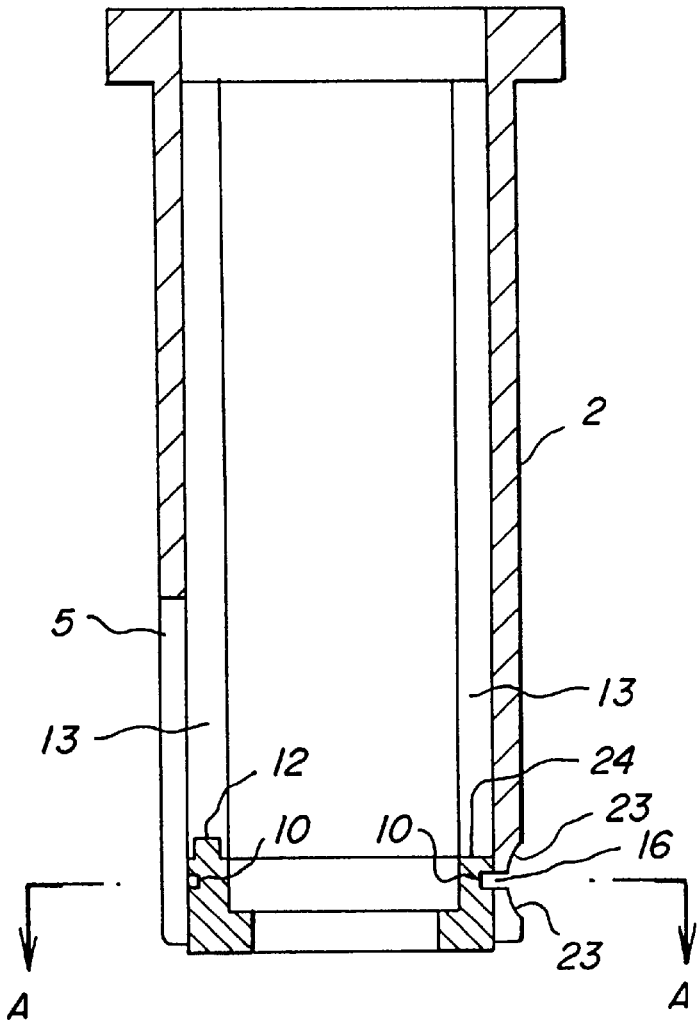
FIG. 3 is a central longitudinal cross-sectional view of a punch guide with the retaining clip removed.

As shown in FIGS. 2 and 3, the stripper plate 6 includes an aperture 11 through which the punch tip is guided. The size and shape of aperture 11 will of course vary depending upon the size and shape of the punch tip. The stripper plate 6 also includes a lug 12 which extends perpendicularly upwardly from the top end 28 and is designed to fit inside one or more longitudinal slots 13 in the interior of the punch guide 2, as shown in FIG. 3. This helps to retain the stripper plate 6 in the proper position in the punch guide 2 so that it does not rotate with respect to the punch guide 2.

Figure 4:
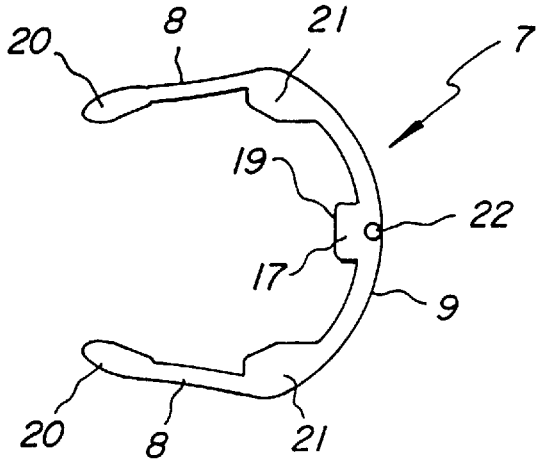
FIG. 4 is a top plan view of a retaining clip.

FIG. 4 shows a preferred embodiment of retaining clip 7. In the preferred embodiment, the retaining clip includes two side arms 8. Side arms 8 are connected at their ends by a bar 9, forming a C-shape. The arms 8 resiliently engage the sidewalls of the stripper plate 6. Thus, it is preferable that the stripper plate include a groove 10 in the sidewalls as shown in FIGS. 2 and 3 for receiving the side arms 8 of the retaining clip 7. The groove 10 preferably extends around the entire circumference of the stripper plate 6 as the stripper plate 6 may be rotated to different positions, i.e., such that lug 12 may be received within different longitudinal slots 13 inside the punch guide 2.

Figure 5:
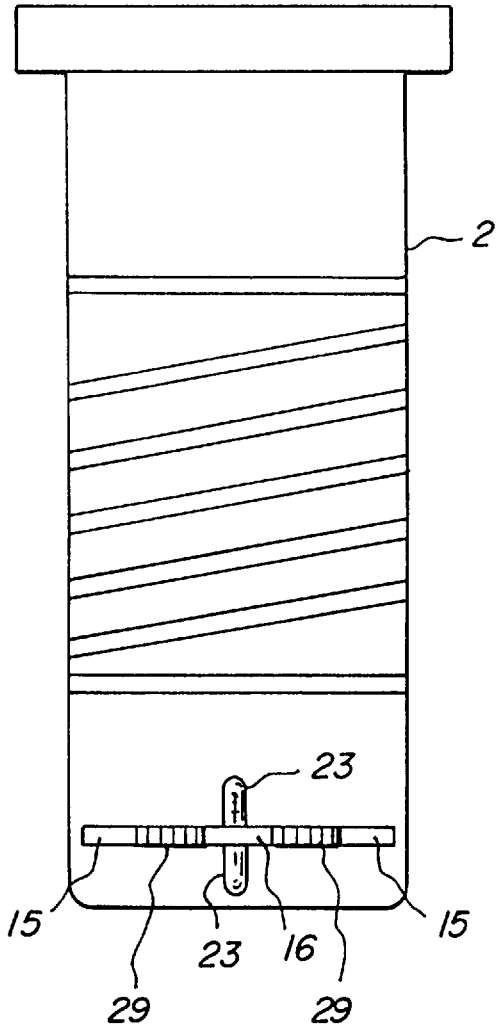
FIG. 5 is a front elevational view of a punch guide in which the openings for insertion of a retaining clip are shown.
Figure 6:
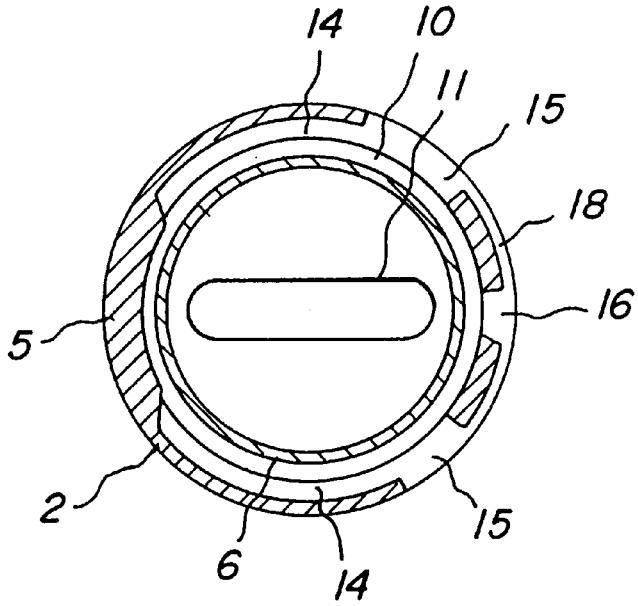
FIG. 6 is a cross-sectional view through the line A—A in FIG. 3.
Figure 7:
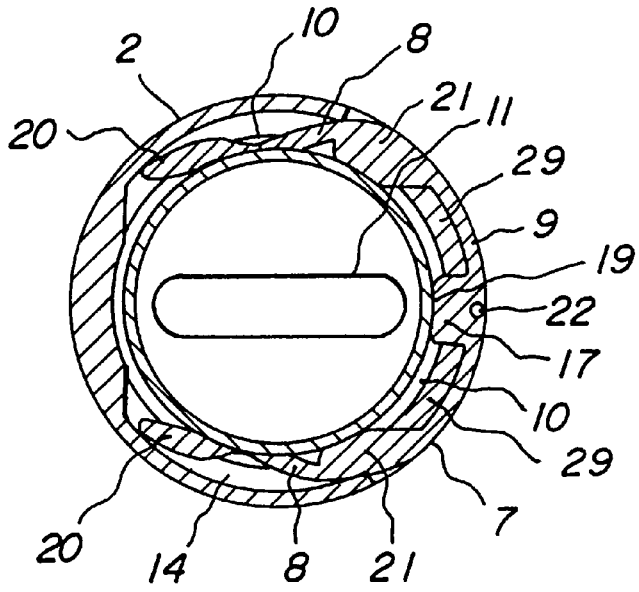
FIG. 7 is a cross-sectional view through the line A—A in FIG. 3 after insertion of a retaining clip.

As shown in FIGS. 5 and 6, punch guide 2 includes openings 15 for receiving respective side arms 8 of the retaining clip 7. These openings 15 are aligned with groove 10 when the stripper plate 6 is fully inserted into the punch guide 2. Punch guide 2 may include slight indentations 23 in the exterior wall near opening 16 which allow retaining clip 7 to be more easily grasped when removed from the punch guide. Punch guide 2 may also include an opening 16 for receiving protrusion 17 on the retaining clip. Protrusion 17, when positioned in opening 16, helps to prevent the retaining clip 7 from rotating relative to the punch guide 2 and stripper plate 6. Thus, when retaining clip 7 is inserted into punch guide 2 the edge 19 of protrusion 17 lies flat against the groove 10 as shown in FIG. 7.

A groove 18, as shown in FIG. 6, is also provided in the exterior of the punch guide 2 for receiving bar 9. Thus, bar 9 lies flat against areas 29 of punch guide 2 as shown in FIG. 7. Retaining clip 7 preferably includes a small notch 22 or other means by which the retaining clip 7 may be easily grasped for removal of the retaining ring. For example, a small wire ring may be located in notch 22 to allow retaining clip 7 to be easily pulled out of punch guide 2.

In the preferred embodiment, the inner sidewalls of the punch guide 2 also include grooves 14 extending in a circumferential direction which align with the groove 10 in the stripper plate 6 when the stripper plate 6 is completely inserted into the lower open end of the punch guide 2. In contrast to groove 10 in the stripper plate 6, grooves 14 in the punch guide 2 need not extend around the full circumference of the punch guide 2. Retaining clip 7 includes protrusions 20 at ends thereof which extend into the grooves 14 in the punch guide 2 to more securely hold the stripper plate 6 in place inside the punch guide 2. Protrusions 21 extend inwardly to engage groove 10 of the stripper plate and also extend outwardly to engage groove 14 of the punch guide 2.

Although the invention has been described in considerable detail with respect to preferred embodiments thereof, variations and modifications will be apparent to those skilled in the art without departing from the spirit and scope of the invention as set forth in the claims.

We claim:

1. A punch guide assembly for use in a punch tool comprising:

a longitudinally extending guide comprising a tube having at least one open end and at least one opening in a sidewall thereof, said at least one opening being transverse to the longitudinal direction of the punch guide;

a stripper plate insertable within said open end; and a generally flat retaining clip having opposed arms, said arms being insertable through the sidewall into said at least one transverse opening from an exterior of said punch guide, said arms engaging respective sides of said stripper plate when inserted into said punch guide such that said arms are positioned between said punch guide and said stripper plate to retain said stripper plate therein and said retaining clip being removable from said at least one transverse opening to release said stripper plate and allow removal of said stripper plate from said punch guide.

2. The punch guide assembly according to claim 1 wherein said retaining clip comprises two side arms connected at ends thereof by a bar to form a C-shape, said two side arms resiliently engaging opposite sidewalls of said stripper plate when said retaining clip is inserted into said at least one opening for retaining said stripper plate in an operative position.

3. The punch guide assembly according to claim 2 wherein said stripper plate includes at least one groove in an exterior sidewall thereof such that said groove is aligned with said at least one opening when said stripper plate is operatively inserted into said punch guide, said two side arms of said retaining clip engaging said groove when inserted into said at least one opening.

4. The punch guide assembly according to claim 3 wherein said punch guide includes at least one groove in an interior wall thereof, said groove in said punch guide being aligned with said groove in said stripper plate when said stripper plate is operatively inserted into said punch guide, said side arms of said retaining clip including protrusions extending into said groove in said punch guide when said retaining clip is inserted into said at least one opening.

5. The punch guide assembly according to claim 3 wherein said groove comprises a single groove extending around a circumference of said stripper plate.

6. The punch guide assembly according to claim 2 wherein said punch guide includes two openings for receiving respective side arms of said retaining clip.

7. The punch guide assembly according to claim 1, wherein said punch guide includes a plurality of longitudinally extending slots in an interior surface of the punch guide and said stripper plate includes a lug extending perpendicularly outward from a top end thereof, said lug being receivable in any one of said slots for preventing rotation of said stripper plate with respect to said punch guide.

* * * * *